US011578627B2

(12) United States Patent
Yang

(10) Patent No.: US 11,578,627 B2
(45) Date of Patent: Feb. 14, 2023

(54) DEVICE FOR CONTROLLING EXHAUST SOUND OF VEHICLE

(71) Applicants: Hyundai Motor Company, Seoul (KR); Kia Motors Corporation, Seoul (KR)

(72) Inventor: Young Dug Yang, Seoul (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 723 days.

(21) Appl. No.: 16/591,182

(22) Filed: Oct. 2, 2019

(65) Prior Publication Data

US 2020/0332687 A1 Oct. 22, 2020

(30) Foreign Application Priority Data

Apr. 16, 2019 (KR) ..... 10-2019-0044014

(51) Int. Cl.
*F01N 1/16* (2006.01)
*F01N 1/10* (2006.01)
*F01N 13/00* (2010.01)

(52) U.S. Cl.
CPC ..... *F01N 1/163* (2013.01); *F01N 1/10* (2013.01); *F01N 13/007* (2013.01); *F01N 2260/20* (2013.01); *F01N 2310/02* (2013.01)

(58) Field of Classification Search
CPC . F01N 1/10; F01N 1/125; F01N 1/163; F01N 13/007; F01N 3/033; F01N 3/0335; F01N 3/2885; F01N 2260/20; F01N 2310/02; F02M 35/1294
See application file for complete search history.

(56) References Cited

U.S. PATENT DOCUMENTS

| | | | | |
|---|---|---|---|---|
| 7,353,791 | B2 * | 4/2008 | Sasaki | F02M 35/10019 123/184.56 |
| 8,177,022 | B2 * | 5/2012 | Honji | G10K 11/22 181/204 |
| 8,322,486 | B2 * | 12/2012 | Ohta | F02M 35/1294 123/184.57 |
| 8,634,574 | B2 * | 1/2014 | Mah | B60R 13/08 381/86 |
| 9,097,222 | B2 * | 8/2015 | Cho | F02M 35/1222 |
| 9,706,322 | B2 * | 7/2017 | Cox | H04R 29/00 |
| 9,790,903 | B2 * | 10/2017 | Takahashi | F02M 35/1294 |
| 9,926,896 | B2 * | 3/2018 | Nakashima | F02M 35/1294 |
| 10,753,325 | B2 * | 8/2020 | Hayashi | G10K 11/172 |
| 2002/0157897 | A1 * | 10/2002 | Hofmann | F02B 77/13 181/227 |

(Continued)

*Primary Examiner* — Jeremy A Luks

(74) *Attorney, Agent, or Firm* — Fox Rothschild LLP

(57) ABSTRACT

A device for controlling an exhaust sound of a vehicle includes a sound tunnel mounted near a muffler and an exhaust pipe so as to transmit exhaust sound to an interior of a vehicle, a sound introduction hole formed in the sound tunnel, and a catalytic assembly mounted in the sound tunnel so as to clog the sound introduction hole, the catalytic assembly functioning to reduce high-frequency noise and to filter exhaust gas, thereby reducing high-frequency noise included in the exhaust sound transmitted to the interior of the vehicle and thereby filtering the exhaust gas so as to prevent introduction of the exhaust gas into the interior of the vehicle.

7 Claims, 4 Drawing Sheets

(56) References Cited

U.S. PATENT DOCUMENTS

| | | | | |
|---|---|---|---|---|
| 2004/0094112 | A1* | 5/2004 | Hoffmann | G10K 11/22<br>123/184.57 |
| 2012/0224998 | A1* | 9/2012 | Lee | F01N 3/2828<br>422/180 |

* cited by examiner

DEVICE FOR CONTROLLING EXHAUST SOUND OF VEHICLE

CROSS-REFERENCE TO RELATED APPLICATION

This application claims under 35 U.S.C. § 119(a) the benefit of Korean Patent Application No. 10-2019-0044014 filed on Apr. 16, 2019, the entire contents of which are incorporated herein by reference.

BACKGROUND

(a) Technical Field

The present disclosure relates to a device for controlling an exhaust sound of a vehicle, more particularly, to the device for controlling the exhaust sound configured to reduce high-frequency noise included in the exhaust sound transmitted to an interior of the vehicle and to prevent the introduction of exhaust gas into the interior of the vehicle.

(b) Description of the Related Art

In general, exhaust pipes are provided with mufflers for reducing exhaust noise caused by differences between exhaust pressure and atmospheric pressure. However, in a vehicle designed to have high output power, such as high-performance vehicles, exhaust pipes are provided with additional devices for controlling exhaust sound in order to provide a sporty sound, rather than to simply reduce exhaust noise.

Such a device for controlling exhaust sound is configured to have a structure in which a muffler is provided therein with an additional resonant chamber through which exhaust gas passes, or is configured as a sound-tunnel type so as to introduce the exhaust sound into the interior of a vehicle.

"Sound-tunnel type" refers to a type in which a sound tunnel having a sound introduction hole is mounted near a muffler and an exhaust pipe so as to allow exhaust sound to be introduced into the sound tunnel through the sound introduction hole and to be transmitted to the interior of a vehicle through the sound tunnel.

However, because high-frequency noise (for example, an airflow sound component generated during high-speed running) is included in exhaust gas, which is introduced into the sound tunnel through the sound introduction hole, there is a problem in that the sensory quality of the exhaust sound introduced into the interior is deteriorated.

In addition, because exhaust sound is introduced through the sound introduction hole formed in the sound tunnel together with exhaust gas discharged from an exhaust pipe, there is a problem in that the exhaust gas may enter the interior of the vehicle through the sound tunnel.

The above information disclosed in this Background section is only for enhancement of understanding of the background of the disclosure and therefore it may contain information that does not form the prior art that is already known in this country to a person of ordinary skill in the art.

SUMMARY

The present provides a device for controlling an exhaust sound of a vehicle, in which a catalytic assembly having multiple rows of punched holes formed therein is mounted in a sound introduction hole in a sound tunnel in order to reduce high-frequency noise included in the exhaust sound transmitted to an interior of the vehicle and to filter exhaust gas so as to prevent introduction of the exhaust gas into the interior of the vehicle.

In one aspect, the present disclosure provides a device for controlling an exhaust sound of a vehicle, including a sound tunnel mounted near a muffler and an exhaust pipe so as to transmit exhaust gas to an interior of a vehicle, a sound introduction hole formed in the sound tunnel, and a catalytic assembly mounted in the sound tunnel so as to clog the sound introduction hole, the catalytic assembly functioning to reduce high-frequency noise and to filter the exhaust gas.

In a preferred embodiment, the device may further include an electronic variable valve mounted on the exhaust pipe so as to control a degree of opening of the exhaust pipe in response to a control signal from an electronic control unit (ECU) of an engine, and an on-off valve coaxially connected to a valve plate of the electronic variable valve so as to control a degree of opening of the sound introduction hole.

In another preferred embodiment, the on-off valve may include a valve shaft, coaxially connected to the valve plate of the electronic variable valve, and a rotating plate, integrally formed at an end of the valve shaft and having a control hole formed therethrough so as to control the degree of opening of the sound introduction hole.

In still another preferred embodiment, the catalytic assembly may include a catalytic carrier including a plurality of cells, which extend longitudinally, a high-frequency noise reducer surrounding the catalytic carrier, and a casing covering an outer peripheral surface of the high-frequency noise reducer and mounted in the sound tunnel.

In yet another preferred embodiment, the catalytic carrier may include multiple rows of punched holes formed there through for introducing high-frequency noise into the high-frequency noise reducer.

In still yet another preferred embodiment, the high-frequency noise reducer may be composed of a wool material so as to have a pipe shape.

In a further preferred embodiment, the plurality of cells, which are formed in the catalytic carrier, may be classified into high-density cells and low-density cells in a circumferential direction.

In another further preferred embodiment, the high-density cells may be formed so as to correspond to a range of about 50-100% of an area of the sound introduction hole, and the low-density cells may be formed so as to correspond to a range of 0% to less than 50% of the area of the sound introduction hole.

Other aspects and preferred embodiments of the disclosure are discussed infra.

BRIEF DESCRIPTION OF THE DRAWINGS

The above and other features of the present disclosure will now be described in detail with reference to certain exemplary embodiments thereof illustrated in the accompanying drawings which are given herein below by way of illustration only, and thus are not limitative of the present disclosure, and wherein.

DETAILED DESCRIPTION

Figure 1:
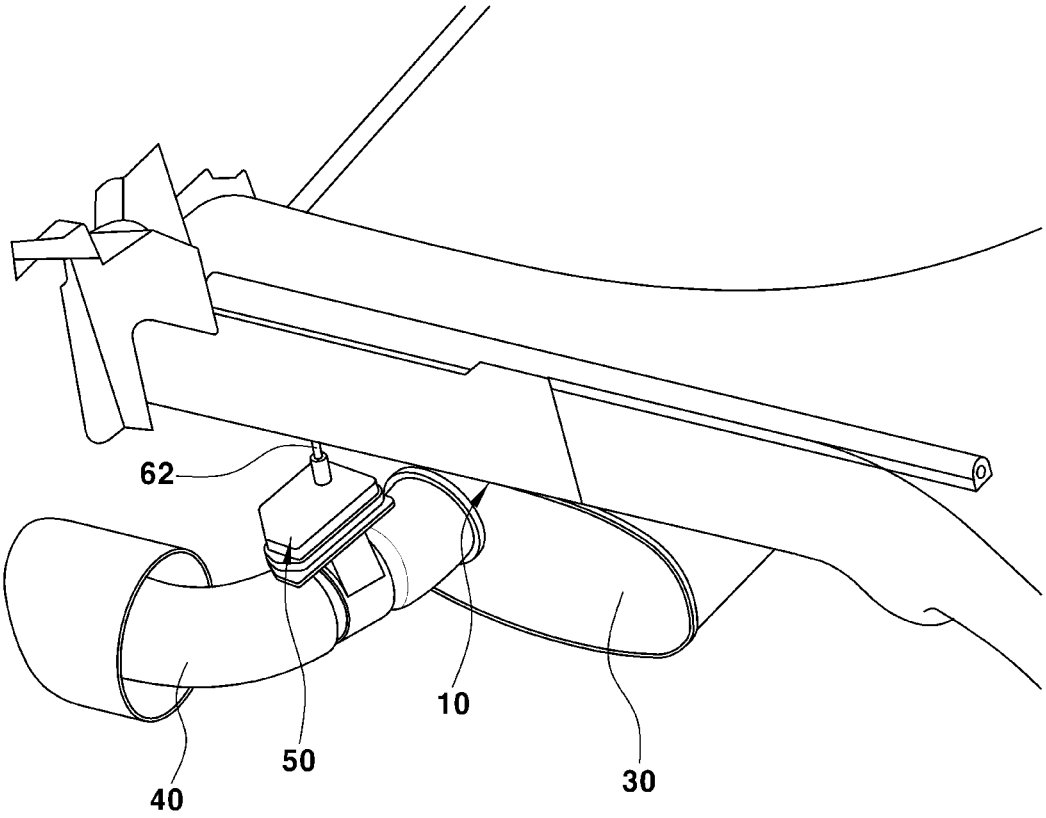
FIG. 1 is a perspective view illustrating a device for controlling an exhaust sound of a vehicle according to an embodiment of the present disclosure.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g., fuels derived from resources other than petroleum). As referred to herein, a hybrid vehicle is a vehicle that has two or more sources of power, for example both gasoline-powered and electric-powered vehicles.

The terminology used herein is for the purpose of describing particular embodiments only and is not intended to be limiting of the disclosure. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Throughout the specification, unless explicitly described to the contrary, the word "comprise" and variations such as "comprises" or "comprising" will be understood to imply the inclusion of stated elements but not the exclusion of any other elements. In addition, the terms "unit", "-er", "-or", and "module" described in the specification mean units for processing at least one function and operation, and can be implemented by hardware components or software components and combinations thereof.

Further, the control logic of the present disclosure may be embodied as non-transitory computer readable media on a computer readable medium containing executable program instructions executed by a processor, controller or the like. Examples of computer readable media include, but are not limited to, ROM, RAM, compact disc (CD)-ROMs, magnetic tapes, floppy disks, flash drives, smart cards and optical data storage devices. The computer readable medium can also be distributed in network coupled computer systems so that the computer readable media is stored and executed in a distributed fashion, e.g., by a telematics server or a Controller Area Network (CAN).

Hereinafter, reference will be made in detail to various embodiments of the present disclosure, examples of which are illustrated in the accompanying drawings and described below. While the disclosure will be described in conjunction with exemplary embodiments, it will be understood that the present description is not intended to limit the disclosure to those exemplary embodiments. On the contrary, the disclosure is intended to cover not only the exemplary embodiments, but also various alternatives, modifications, equivalents and other embodiments, which may be included within the spirit and scope of the disclosure as defined in the appended claims.

Hereinafter, a preferred embodiment of the present disclosure will be described in detail with reference to the accompanying drawings.

Figure 2:
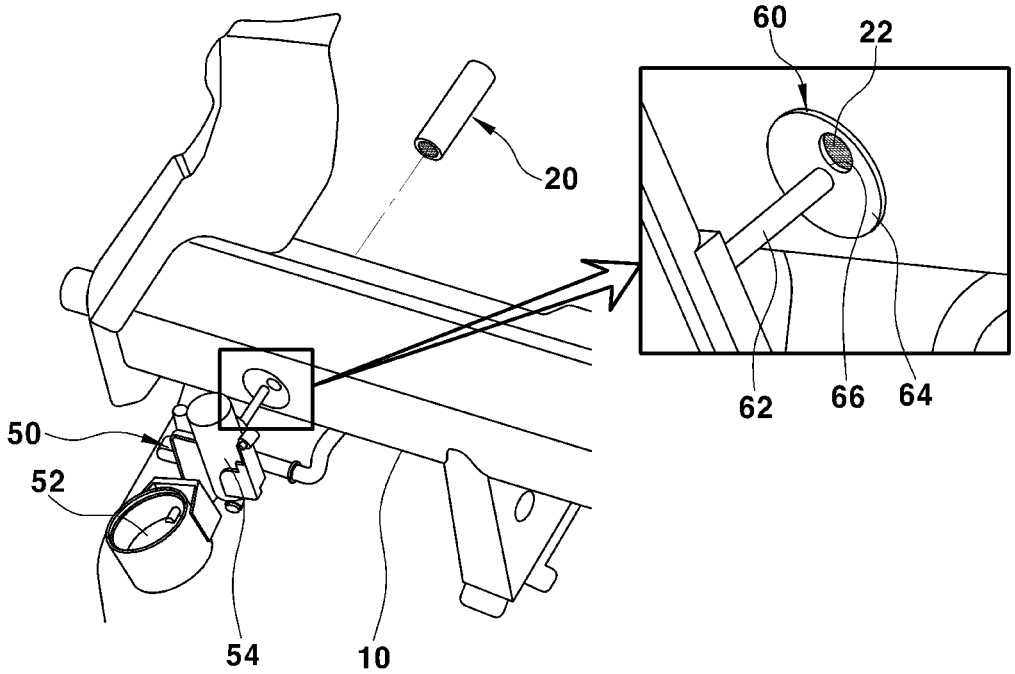
FIG. 2 is a bottom perspective view of the device for controlling the exhaust sound of the vehicle according to the embodiment of the present disclosure, from which an exhaust pipe is removed so as to show an electronic variable valve.

In the accompanying drawings, FIG. 1 is a perspective view of a device for controlling the exhaust sound of a vehicle according to an embodiment of the present disclosure, which is viewed from above. FIG. 2 is a perspective view of the device for controlling the exhaust sound of the vehicle according to the embodiment of the present disclosure, which is viewed from the underside.

In the drawings, reference numeral "10" denotes a sound tunnel.

The sound tunnel 10, which is composed of a hollow frame having therein a tunnel for sound transmission, is mounted near a muffler 30 and an exhaust pipe 40, through which exhaust sound is discharged, so as to transmit exhaust sound to an interior of the vehicle.

Here, the sound tunnel 10 is provided in a predetermined location thereof with a sound introduction hole 12 formed there through, which directs exhaust sound into the sound tunnel 10.

The sound tunnel 10 is provided therein with a catalytic assembly 20, which blocks the sound introduction hole 12.

The catalytic assembly 20 functions to reduce high-frequency noise included in the exhaust sound introduced into the sound tunnel 10 (for example, airflow sound component generated during high-speed running) as well as to filter the exhaust gas introduced into the sound tunnel.

Figure 3:
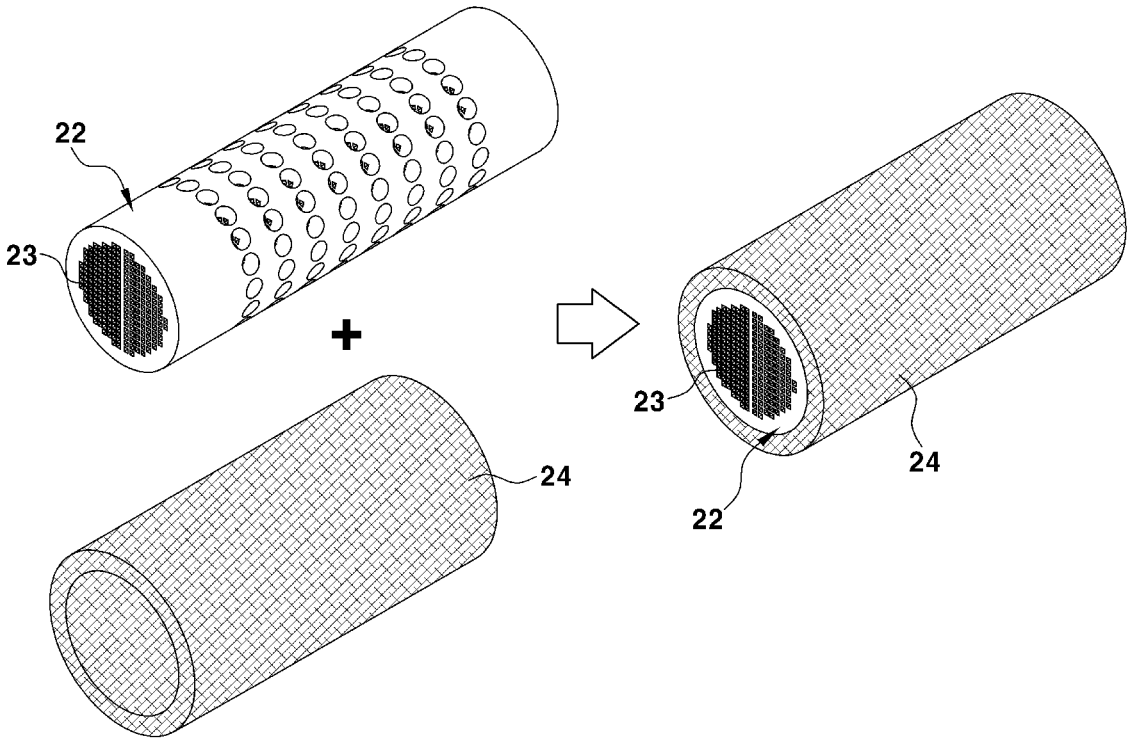
FIGS. 3 and 4 are perspective views illustrating a catalytic assembly of the device for controlling the exhaust sound of the vehicle according to the embodiment of the present disclosure.
Figure 4:
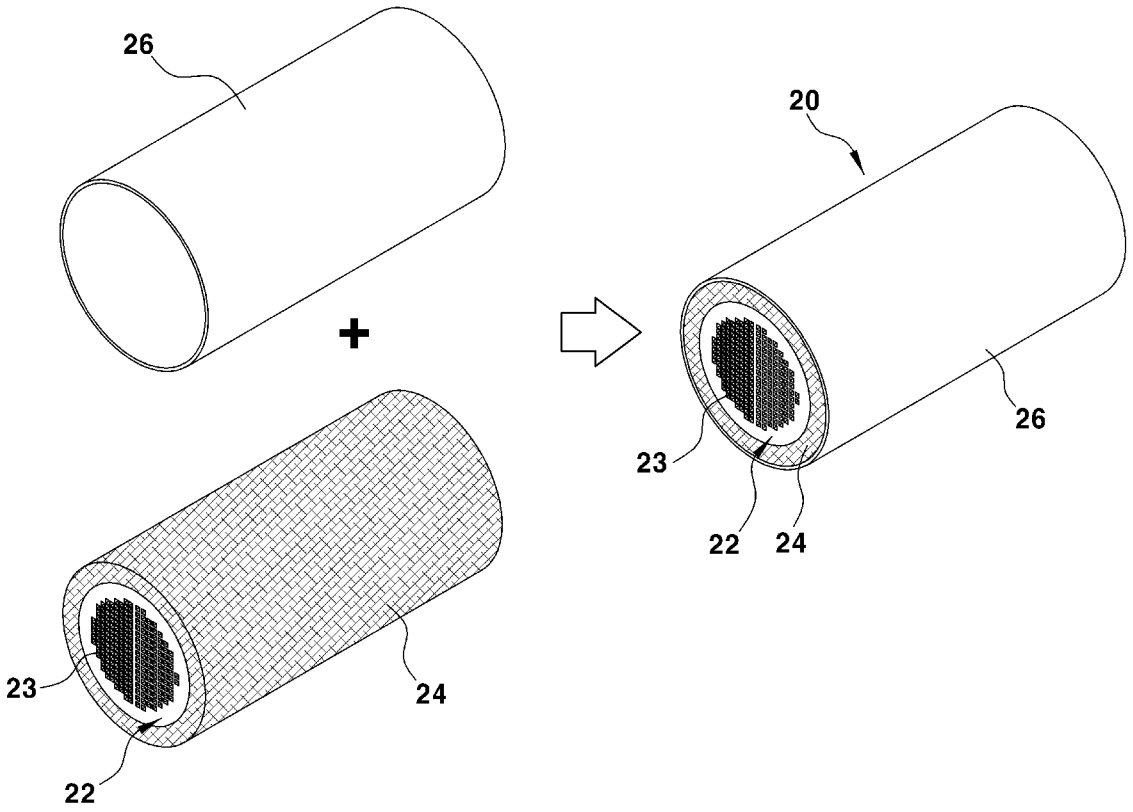

To this end, the catalytic assembly 20 includes a catalytic carrier 22 including a plurality of cells 23, which extend in the longitudinal direction, a high-frequency noise reducer 24 surrounding the catalytic carrier 22, and a casing 26, which surrounds the outer peripheral surface of the high-frequency noise reducer 24 and is mounted in the sound tunnel 10, as illustrated in FIGS. 3 and 4.

Preferably, the catalytic carrier 22 is provided in the outer peripheral portion thereof with multiple rows of punched holes 25 for introducing high-frequency noise included in exhaust sound into the high-frequency noise reducer 24.

In order to eliminate high-frequency noise from the exhaust sound, the high-frequency noise reducer 24 preferably is composed of a wool material so as to have a pipe shape.

Accordingly, the catalytic assembly 20 according to the embodiment of the present disclosure is manufactured in such a way as to fit the catalytic carrier 22 into the pipe-shaped high-frequency noise reducer 24, as illustrated in FIG. 3, and to fit the high-frequency noise reducer 24, including the catalytic carrier 22 fitted therein, into the hollow casing 26 made of a steel material, as illustrated in FIG. 4.

The catalytic assembly 20, which has been assembled in this way, is mounted in the sound tunnel 10.

Specifically, the catalytic assembly 20 is mounted in the sound tunnel 10 in such a way that the catalytic carrier 22 is disposed in the sound tunnel 10 such that the front portion of the catalytic carrier 22 blocks the sound introduction hole 12 and then the casing 26 is fastened to the inner wall of the sound tunnel 10 by means of welding or a bracket and a bolt.

Here, when the sound introduction hole in the sound tunnel is viewed from the outside, the front surface of the catalytic carrier 22, which blocks the sound introduction hole 12, is visible, as illustrated in FIG. 2.

Consequently, high-frequency noise included in exhaust sound, which is introduced into the sound tunnel 10 through the sound introduction hole 12 (for example, airflow sound component generated during high-speed running), is introduced into the high-frequency noise reducer 24 through the multiple punched holes 25 in the catalytic carrier 22, and the high-frequency noise reducer 24 preferably made of a wool material absorbs and eliminates high-frequency noise.

In addition, since exhaust gas, which has been introduced through the sound introduction hole 12 formed in the sound tunnel 10, is filtered through the catalytic carrier 22, it is possible to easily prevent a phenomenon whereby exhaust gas is introduced into the interior of the vehicle through the sound tunnel.

Referring to FIG. 1, an electronic variable valve 50, which is adapted to control the degree of opening of the exhaust pipe 40 in response to a control signal from an electronic control unit (ECU) of an engine, is mounted on the exhaust pipe 40, which extends from the muffler 30.

In particular, the electronic variable valve 50 includes a motor 54, which operates in response to a control signal (for example, an RPM signal of the engine) from the ECU of the engine. Accordingly, a degree of opening of the exhaust pipe 40 is controlled by the rotation of a valve plate 52 of the electronic variable valve 50 owing to the operation of the motor 54.

Referring to FIG. 2, in which the exhaust pipe is omitted, a degree of opening of the sound introduction hole 12 is controlled by an on-off valve 60, which is coaxially connected to the valve plate 52 of the electronic variable valve 50.

Preferably, the on-off valve 60 includes a valve shaft 62, which is coaxially connected to the valve plate 52 of the electronic variable valve 50, and a rotating plate 64, which is integrally formed at the end of the valve shaft 62. The rotating plate 64 is provided with a control hole 66, which is formed there through so as to control the degree of opening of the sound introduction hole 12.

Here, the motor 54 of the electronic variable valve 50, which is embodied by a two-way output motor, is connected at one output shaft thereof to the valve plate 52 of the electronic variable valve 50, and is connected at the other output shaft thereof to the valve shaft 62 of the on-off valve 60. Consequently, the valve plate 52 and the valve shaft 62 are simultaneously moved in the state of being coaxially connected to each other, with the motor 54 being disposed there between.

The operation of the device for controlling the exhaust sound of a vehicle according to the embodiment of the present disclosure, which is constructed in the above manner, will now be described.

First, when a control signal of the ECU of the engine (for example, an RPM signal of the engine) is transmitted to the electronic variable valve 50, the motor 54 of the electronic variable valve 50 is operated. By virtue of the operation of the motor 54, the valve plate 52 is rotated, thereby controlling the degree of opening of the exhaust pipe 40.

Figure 5:
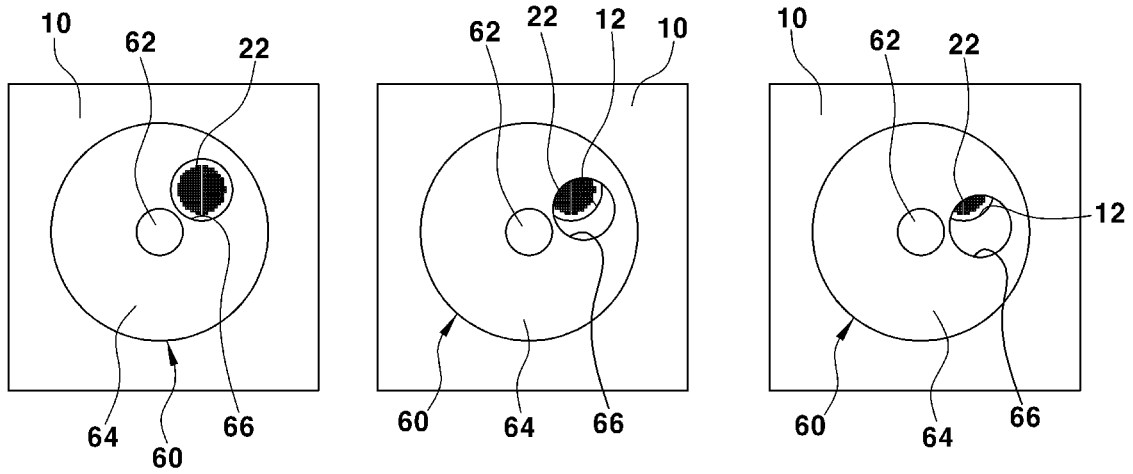
FIG. 5 is a cross-sectional view showing the state in which a degree of opening of a sound introduction hole of the device for controlling the exhaust sound of the vehicle according to the embodiment of the present disclosure is controlled.

Further, when the valve plate 52 is rotated by virtue of the operation of the motor 54 of the electronic variable valve 50, the output from the motor 54 is also transmitted to the valve shaft 62 of the on-off valve 60, thereby rotating the rotating plate 64. At this time, as the control hole 66 formed in the rotating plate 64 becomes aligned or misaligned with the sound introduction hole 12, the degree of opening of the sound introduction hole 12 is controlled, as illustrated in FIG. 5.

In other words, when a high RPM signal from the ECU of the engine, which indicates a predetermined RPM or higher, is transmitted to the electronic variable valve 50 during high-speed running, the valve plate 52 is further rotated in the open direction by the operation of the motor 54, thus increasing the degree of opening of the exhaust pipe 40. At the same time, as the valve shaft 62 and the rotating plate 64 are rotated in the same direction by the operation of the motor 54, the control hole 66 continuously becomes aligned with the sound introduction hole 12, thus increasing the degree of opening of the sound introduction hole 12.

In contrast, when a low RPM signal from the ECU of the engine, which indicates a level lower than the predetermined RPM, is transmitted to the electronic variable valve 50 during low-speed running, the valve plate 52 is further rotated in the closed direction by the operation of the motor 54, thus decreasing the degree of opening of the exhaust pipe 40. At the same time, as the valve shaft 62 and the rotating plate 64 are rotated in the same direction by the operation of the motor 54, the control hole 66 continuously becomes misaligned with the sound introduction hole 12, thus decreasing the degree of opening of the sound introduction hole 12.

Consequently, exhaust gas and exhaust sound, having passed through the muffler 30, are discharged to the outside through the exhaust pipe 40, the degree of opening of which is controlled, and then the discharged exhaust gas and exhaust sound are introduced into the sound introduction hole 12 in the sound tunnel 10, the degree of opening of which is controlled.

Here, the exhaust sound, which is introduced into the sound introduction hole 12, passes through the catalytic carrier 22, which blocks the sound introduction hole 12, and is transmitted to the interior of the vehicle along the inside of the sound tunnel 10. In particular, since high-frequency noise included in the exhaust sound that passes through the catalytic carrier 22 (for example, airflow sound component generated during high-speed running) is introduced into the high-frequency noise reducer through the multiple punched holes 25, the high-frequency noise is absorbed by the high-frequency noise reducer 24, which preferably is made of a wool material, and is thus eliminated.

Further, since the exhaust gas, which is introduced into the sound introduction hole 12, is filtered while passing through individual cells 23 of the catalytic carrier 22, it is possible to easily prevent a phenomenon whereby exhaust gas is introduced into the interior of the vehicle through the sound tunnel.

Figure 6:
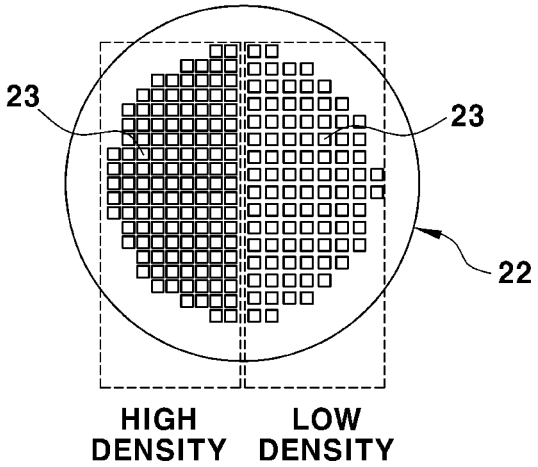
FIG. 6 is a front view illustrating a catalytic carrier of the device for controlling the exhaust sound of the vehicle according to the embodiment of the present disclosure, which includes combination of high-density cells and low-density cells.

Referring to FIG. 6, the plurality of cells 23 formed in the catalytic carrier 22 are configured so as to be classified into high-density cells and low-density cells in a circumferential direction.

Preferably, the high-density cells in the catalytic carrier 22 are formed so as to correspond to a range of about 50-100% of opening degree of the sound introduction hole 12, and the low-density cells are formed so as to correspond to a range of 0% to less than 50% of the opening degree of the sound introduction hole 12.

When a high RPM signal from the ECU of the engine, which indicates a predetermined RPM or higher, is transmitted to the electronic variable valve 50 during high-speed running, the valve plate 52 is further rotated in the open direction by the operation of the motor 54, thus increasing the degree of opening of the exhaust pipe 40 and thus increasing the amount of exhaust gas that is discharged to the outside through the exhaust pipe 40.

As the valve shaft 62 and the rotating plate 64 are rotated in the same direction by the operation of the motor 54 and the control hole 66 thus becomes aligned with the sound introduction hole 12, the degree of opening of the sound introduction hole 12 increases to the range of about 50-100%, thus allowing a larger amount of exhaust gas to be introduced into the sound introduction hole 12.

Here, since the high-density cells of the catalytic carrier 22 are formed so as to correspond to a range of about 50-100% of the opening degree of the sound introduction hole 12, it is possible to easily filter exhaust gas by virtue of the high-density cells of the catalytic carrier 22, even when a large amount of exhaust gas is introduced into the sound introduction hole 12.

Meanwhile, if all of the cells in the catalytic carrier 22 are uniformly applied as high-density cells, the level of exhaust sound at a low speed and a low RPM is lowered overall, and thus there may be a disadvantage of making it impossible to realize a sporty sound. Therefore, it is preferred that the cells in the catalytic carrier 22 be classified into high-density cells and low-density cells and that the density of the cells in the catalytic carrier 22, which is exposed through the sound introduction hole 12 vary depending on the degree of opening of the sound introduction hole 12.

As is apparent from the above description, the present disclosure can provide at least the following effects.

First, since high-frequency noise included in exhaust sound, which is introduced into the sound introduction hole formed in the sound tunnel (for example, airflow sound component generated during high-speed running) is reduced, it is possible to improve sensory quality of the exhaust sound introduced into the interior of the vehicle.

Second, since exhaust gas, which is introduced into the sound tunnel through the sound introduction hole formed in the sound tunnel, is filtered, it is possible to easily prevent a phenomenon whereby the exhaust gas is introduced into the interior of the vehicle through the sound tunnel.

The disclosure has been described in detail with reference to preferred embodiments thereof. However, it will be appreciated by those skilled in the art that changes may be made in these embodiments without departing from the principles and spirit of the disclosure, the scope of which is defined in the appended claims and their equivalents.

What is claimed is:

1. A device for controlling an exhaust sound of a vehicle, comprising:

a sound tunnel mounted near a muffler and an exhaust pipe so as to transmit exhaust sound to an interior of the vehicle;

a sound introduction hole formed in the sound tunnel; and a catalytic assembly mounted in the sound tunnel so as to clog the sound introduction hole, the catalytic assembly functioning to reduce high-frequency noise and to filter exhaust gas, wherein the catalytic assembly comprises:

a catalytic carrier including a plurality of cells, which extend longitudinally;

a high-frequency noise reducer surrounding the circumference of the catalytic carrier, and a casing covering an outer peripheral surface of the high-frequency noise reducer and mounted in the sound tunnel.

2. The device of claim 1, further comprising:

an electronic variable valve mounted on the exhaust pipe so as to control a degree of opening of the exhaust pipe in response to a control signal from an electronic control unit (ECU) of an engine; and an on-off valve coaxially connected to a valve plate of the electronic variable valve so as to control a degree of opening of the sound introduction hole.

3. The device of claim 2, wherein the on-off valve includes a valve shaft coaxially connected to the valve plate of the electronic variable valve, and a rotating plate integrally formed at an end of the valve shaft and having a control hole formed therethrough so as to control the degree of opening of the sound introduction hole.

4. The device of claim 1, wherein the catalytic carrier includes multiple rows of punched holes formed therethrough for introducing high-frequency noise into the high-frequency noise reducer.

5. The device of claim 1, wherein the high-frequency noise reducer is composed of a wool material so as to have a pipe shape.

6. The device of claim 1, wherein the plurality of cells, which are formed in the catalytic carrier, are classified into high-density cells and low-density cells in a circumferential direction.

7. The device of claim 6, wherein the high-density cells are formed so as to correspond to a range of about 50-100% of the opening degree of the sound introduction hole, and the low-density cells are formed so as to correspond to a range of 0% to less than 50% of an area of the sound introduction hole.

* * * * *